US010309161B2

(12) United States Patent
de Barros et al.

(10) Patent No.: US 10,309,161 B2
(45) Date of Patent: Jun. 4, 2019

(54) SYSTEM AND AUTONOMOUS METHOD FOR SECURING A RISER SUPPORT

(71) Applicant: PETRÓLEO BRASILEIRO S.A.—PETROBRAS, Rio de Janeiro (BR)

(72) Inventors: Sergio Batista de Barros, Macaé (BR); Marcelo Costa Vitiello, Macaé (BR)

(73) Assignee: PETRÓLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 15/711,556

(22) Filed: Sep. 21, 2017

(65) Prior Publication Data

US 2018/0087328 A1 Mar. 29, 2018

(30) Foreign Application Priority Data

Sep. 23, 2016 (BR) ..... 10 2016 021963

(51) Int. Cl.

| | |
|---|---|
| ***E21B 17/01*** | (2006.01) |
| ***E21B 43/01*** | (2006.01) |
| ***E21B 19/00*** | (2006.01) |
| *B63B 21/08* | (2006.01) |

(Continued)

(52) U.S. Cl.

CPC ..... *E21B 17/01* (2013.01); *E21B 19/004* (2013.01); *E21B 43/0107* (2013.01); *B63B 21/08* (2013.01); *B63B 21/10* (2013.01); *B63B 2035/4473* (2013.01)

(58) Field of Classification Search

CPC ..... E21B 17/01; E21B 43/0107

See application file for complete search history.

(56) References Cited

U.S. PATENT DOCUMENTS 1,766,920 A * 6/1930 Moody ..... E21B 19/06 294/91

2,009,942 A * 7/1935 Moody ..... E21B 19/06 294/91

(Continued)

*Primary Examiner* — Matthew R Buck

*Assistant Examiner* — Aaron L Lembo

(74) *Attorney, Agent, or Firm* — Sughrue Mion, PLLC

(57) ABSTRACT

The present invention relates to systems for securing connectors of risers in petroleum production units. In this scenario, the present invention provides an autonomous system for securing a riser support, said system comprising (i) a riser support (32) connected at its bottom end to a submerged riser (34) and at its upper end to a tensioning element (30), (ii) a supporting ledge (20) comprising a through-hole (22) through which the tensioning element (30) and at least part of the riser support (32) pass, (iii) a securing device (40) located on the supporting ledge (20), said securing device (40) sliding relative to the supporting ledge (20) and driven by an actuator (48), wherein the securing device (40) slides between an unlocked position and a locked position on the through-hole (22), wherein, in the locked position, the securing device (40) can engage with locking in a connector (38) of the riser support (32) after the connector (38) has passed through the through-hole (22) of the supporting ledge (20). The present invention further provides an autonomous method for securing a riser support associated with the system described above.

14 Claims, 8 Drawing Sheets

(51) Int. Cl.
*B63B 21/10* (2006.01)
*B63B 35/44* (2006.01)

(56) References Cited

U.S. PATENT DOCUMENTS 3,729,941 A * 5/1973 Rochelle ..... E21B 43/0107 166/347
4,116,015 A * 9/1978 Duncan ..... E21B 33/038 24/458
4,174,011 A * 11/1979 Zaremba ..... E21B 41/10 166/341
4,199,847 A * 4/1980 Owens ..... E21B 19/004 188/67
4,275,488 A * 6/1981 Gray ..... E21B 19/10 188/67
4,388,022 A * 6/1983 Gentry ..... E21B 17/015 166/350
4,986,146 A * 1/1991 Buck ..... E21B 19/164 81/57.18
5,092,711 A * 3/1992 Langner ..... E21B 43/0107 166/341
5,269,629 A * 12/1993 Langner ..... F16L 27/103 166/367
5,702,205 A * 12/1997 Mahone ..... E21B 15/02 138/109
5,887,659 A * 3/1999 Watkins ..... E21B 17/01 166/350
5,947,642 A 9/1999 Teixeira et al.
6,142,234 A * 11/2000 Crain ..... E21B 33/038 166/341
6,227,587 B1 * 5/2001 Terral ..... E21B 19/07 188/67
6,386,283 B1 * 5/2002 Mosing ..... E21B 19/06 166/75.14
6,422,316 B1 * 7/2002 Schutz ..... B63B 21/502 166/351
6,460,634 B1 * 10/2002 Hart ..... E21B 19/161 166/77.51
6,494,273 B1 * 12/2002 Martin ..... E21B 19/06 166/77.1
6,536,527 B2 * 3/2003 Munk ..... E21B 19/004 166/341
6,708,766 B2 * 3/2004 Clark ..... E21B 33/076 166/347
6,835,025 B1 * 12/2004 Beard ..... E21B 19/004 405/184.4
7,004,680 B2 * 2/2006 Commander ..... F16L 1/20 248/80
7,322,406 B2 * 1/2008 Wiggins ..... E21B 19/14 166/66
7,373,986 B2 5/2008 Pollack et al.
7,461,700 B2 * 12/2008 Livingston, Jr. ..... E21B 19/10 166/379
7,472,755 B2 * 1/2009 Riggs ..... E21B 17/015 166/359
7,762,343 B2 * 7/2010 Sonneveld ..... E21B 19/10 166/382
7,967,070 B2 6/2011 Reddy
8,550,174 B1 * 10/2013 Orgeron ..... E21B 19/24 166/380
8,573,308 B2 * 11/2013 Baugh ..... E21B 19/24 166/355
9,074,428 B2 * 7/2015 Lavagna ..... E21B 17/015
9,109,404 B2 * 8/2015 Gilmore ..... E21B 17/01
9,404,320 B2 * 8/2016 Gilmore ..... E21B 17/01
2004/0197152 A1 * 10/2004 Beard ..... B63B 21/502 405/224
2008/0277108 A1 * 11/2008 Bouligny, Jr. ..... E21B 19/07 166/77.52
2013/0098606 A1 * 4/2013 Webre ..... E21B 17/026 166/255.1

* cited by examiner

SYSTEM AND AUTONOMOUS METHOD FOR SECURING A RISER SUPPORT

CROSS-REFERENCE TO RELATED APPLICATION

This application claims the benefit of priority to BR 10 2016 021963-9, filed 23 Sep. 2016, which is incorporated herein by reference in its entirety.

FIELD OF THE INVENTION

The present invention relates to systems for securing connectors of risers in petroleum production units.

BACKGROUND OF THE INVENTION

With the discovery of hydrocarbon producing fields located at ever increasing water depths, the use of rigid structures fixed on the sea bed, intended for installation of production equipment, has become more complex by the day. In some cases, owing to the particular conditions of the region where the hydrocarbon producing field is located, their use has become unviable.

In more recent times, floating structures represent an alternative that is used more and more frequently for the installation of production equipment, as they normally offer a lower-cost option compared to fixed structures.

Petroleum production in deep water makes extensive use of riser pipes, also known as risers. This tubing, which may be flexible or rigid, collects the oil produced by the subsea well, and conveys it to a floating unit, and then to tankers, or directly to onshore installations.

The installation and dismantling of the risers in the structure of the floating unit are known as pull-in and pull-out operations. A pull-in/pull-out cable, connected to a submerged supporting system that supports a riser, suspends an assembly of the riser and supporting system until the connector of the latter engages in a support of the stationary production unit (SPU) and can be fixed and secured manually.

The company SBM has developed a system of wedges for fixing and securing the connectors of the supporting systems, especially for supporting systems of the I-tube type, illustrated in FIG. 1.

The fixing and securing of the connector of the supporting system is carried out with the assistance of divers, since these operations are not fully automated.

However, since the method for installing flexible risers conventionally employed in the prior art requires the use of divers and the mobilization of support ships, this method is subject to the sea conditions for a certain period of time. This dependence on the weather conditions may generate unexpected delays in projects, owing to the long waiting periods for good diving conditions.

In an attempt to solve this problem, some techniques for fixing and securing riser supporting systems may be found in the prior art. Some of them are described briefly below.

U.S. Pat. No. 7,373,986B2 discloses a connector for risers comprising a double-click securing system. In the pull-in operation, an enlargement or joint positioned in the upper portion of a riser enters a pocket fixed to the structure of a platform. A joint or enlargement comprises supporting surfaces comprising cams that engage in recesses of the pocket. The pockets are arranged side by side and the engagement of the cams is guided by guides that move the cams angularly until they are located on the recesses. Then the riser is lowered until the cams engage in the recesses.

U.S. Pat. No. 5,947,642A describes a device for coupling flexible risers comprising a tensioner provided with a projection and an angularly moveable retainer for securing the projection automatically when the tensioner is raised into a cylindrical pocket.

U.S. Pat. No. 7,967,070B2 also discloses a connector comprising a funnel/guide assembly to be coupled to an underwater structure, wherein the funnel/guide assembly receives a shaft. The shaft is coupled to a tensioner. A securing assembly is coupled to the funnel/guide assembly, wherein the securing assembly comprises a securing device. Retainers move into and out of the funnel/guide assembly, wherein the retainers are inserted into recesses of the shaft for securing the axial movement of the shaft relative to the funnel/guide assembly. The connector is installed and secured using a remotely operated vehicle (ROV).

Although the prior art comprises various devices and systems for securing supporting systems or tensioners of risers, many of them are complex and/or require precise adjustments for said securing. Moreover, many will need at least the assistance of a ROV, which may make the pull-in/pull-out operation unviable in extreme sea conditions.

As will be explained in detail hereunder, the present invention aims to provides a simple, low-cost alternative for automatic installation and securing of supporting systems.

SUMMARY OF THE INVENTION

It is an aim to provide a system and autonomous method for securing a riser support that preferably does not require diving operations for manual connection and disconnection of the system or the need for the assistance of a ROV.

Thus, in order to achieve this aim, the present disclosure provides an autonomous system for securing or releasing a riser support, wherein the autonomous system comprises at least one or more of the following features: a riser support connectable at its bottom end to a submerged riser and at its upper end to a tensioning element, the riser support having a connector; a supporting ledge comprising a through-hole, through which the tensioning element and at least part of the riser support may pass; a securing device located on the supporting ledge, said securing device being slidable relative to the supporting ledge and driven by an actuator; wherein the securing device is configured to slide, with respect to the through-hole, between an unlocked position and a locked position, wherein, in the locked position, the securing device can engage the connector of the riser support after the connector has passed through the through-hole of the supporting ledge, so as to prevent the connector from passing back through the through-hole.

According to another aspect of the disclosure, there is provided an autonomous method for securing a riser support, wherein the method comprises one or more of the steps of: passing, through a through-hole of a supporting ledge, at least part of a riser support connected at its bottom end to a submerged riser and at its upper end to a tensioning element; and sliding, relative to the supporting ledge, a securing device located on the supporting ledge, said securing device being driven by an actuator, wherein the securing device slides between an unlocked position and a locked position relative to the through-hole, wherein, in the locked position, the securing device can engage with a connector of the riser support after the connector has passed through the through-hole of the supporting ledge, so as to prevent the connector from returning through the through-hole.

According to another aspect of the disclosure, there is provided an autonomous method for releasing a riser support, wherein the method comprises one or more of the steps of: providing a securing device in a locked position on a supporting ledge, engaged with a riser support, so as to prevent the riser support passing through a through-hole of a supporting ledge, wherein the riser support is connected at its bottom end to a submerged riser and at its upper end to a tensioning element; sliding, relative to the supporting ledge, the securing device, said securing device being driven by an actuator, wherein the securing device slides between the locked position and an unlocked position relative to the through-hole in the supporting ledge, so as to disengage from the riser support; and passing, through the through-hole of the supporting ledge, at least part of the riser support.

According to another aspect of the disclosure, there is provided an autonomous system for securing a riser support, comprising (i) a riser support connected at its bottom end to a submerged riser and at its upper end to a tensioning element, (ii) a supporting ledge comprising a through-hole through which the tensioning element and at least part of the riser support pass, and (iii) a securing device located on the supporting ledge, the securing device sliding relative to the supporting ledge and actuated by an actuating means, wherein the securing device slides between an unlocked position and locked position on the through-hole, wherein, in the locked position, the securing device can engage with locking in a connector of the riser support after the connector has passed through the through-hole of the supporting ledge.

The present disclosure further provides an autonomous method for securing a riser support, comprising the steps of (i) passing, through a through-hole of a supporting ledge, at least part of a riser support connected at its bottom end to a submerged riser and at its upper end to a tensioning element and (ii) sliding, relative to the supporting ledge, a securing device located on the supporting ledge, the securing device being actuated by an actuating means, wherein the securing device slides between an unlocked position and a locked position on the through-hole, wherein, in the locked position, the securing device can engage with locking in a connector of the riser support after the connector has passed through the through-hole of the supporting ledge.

According to one aspect of the disclosure, there is proposed an autonomous system for securing a riser support, characterized in that it comprises one or more of the following features: a riser support connected at its bottom end to a submerged riser and at its upper end to a tensioning element; a supporting ledge comprising a through-hole, through which the tensioning element and at least part of the riser support pass; a securing device located on the supporting ledge, said securing device sliding relative to the supporting ledge and driven by an actuator; wherein the securing device slides between an unlocked position and a locked position on the through-hole, wherein, in the locked position, the securing device can engage with locking in a connector of the riser support after the connector has passed through the through-hole of the supporting ledge.

A further aspect of the disclosure provides that the securing device slides on at least one rail located on the supporting ledge.

A further aspect of the disclosure provides that the securing device is lockable in the locked position by means of at least one locking pin that can engage in at least one securing hole of the supporting ledge.

A further aspect of the disclosure provides that the at least one locking pin is driven by at least one hydraulic locking cylinder.

A further aspect of the disclosure provides that the actuator is at least one hydraulic displacement cylinder.

A further aspect of the disclosure provides that the securing device comprises a horseshoe shape where there is a front opening for positioning said securing device around the connector of the riser support.

A further aspect of the disclosure provides that the securing device comprises an upper surface that comes into contact with the connector of the riser support, inclined in at least one direction relative to a bottom surface.

A further aspect of the disclosure provides that the inclination of the upper surface of the securing device relative to at least one direction corresponds to at least one of the catenary angle and the azimuth angle of the riser.

A further aspect of the disclosure provides that the riser support is a support of the I-tube type or MFBM.

A further aspect of the disclosure provides an autonomous method for securing a riser support, characterized in that it comprises one or more of the steps of: passing, through a through-hole of a supporting ledge, at least part of a riser support connected at its bottom end to a submerged riser and at its upper end to a tensioning element; sliding, relative to the supporting ledge, a securing device located on the supporting ledge, said securing device being driven by an actuator, wherein the securing device slides between an unlocked position and a locked position on the through-hole, wherein, in the locked position, the securing device can engage with locking in a connector of the riser support after the connector has passed through the through-hole of the supporting ledge.

A further aspect of the disclosure provides that it comprises an additional step of locking the securing device in the locked position by means of at least one locking pin that can engage in at least one securing hole of the supporting ledge.

A further aspect of the disclosure provides that it comprises an additional step of unlocking the securing device in the locked position by releasing at least one locking pin of the at least one securing hole of the supporting ledge.

BRIEF DESCRIPTION OF THE FIGURES

The detailed description presented hereunder refers to the appended figures and their respective reference numbers, representing the embodiments of the present disclosure.

DETAILED DESCRIPTION OF THE INVENTION

Figure 1:
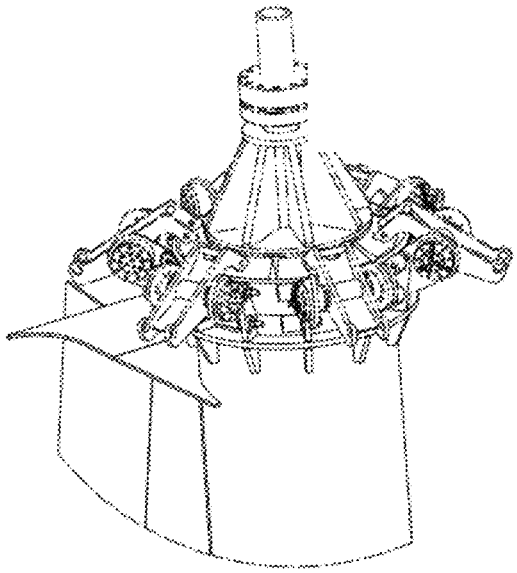
FIG. 1 (prior art)
FIG. 1 shows a system of wedges for fixing and securing connectors of supporting systems of the I-tube type as known in the prior art.

Firstly, it is emphasized that the description that follows will be based on a preferred embodiment of the disclosure. As will be obvious to a person skilled in the art, however, the invention is not limited to this particular embodiment.

FIGS. 2 to 8 show isometric views of a portion of a body 10 of a stationary production unit (SPU) where the system of the present disclosure is installed.

The present system comprises a supporting ledge 20, which is submerged. The ledge 20 comprises a through-hole 22 through which a tensioning element 30 can pass. Tensioning element 30 is a steel cable in some embodiment. In some embodiments, tensioning element 30 is at least part of a riser support 32. The supporting ledge 20 is fixed relative to the body 10 of the SPU.

A riser support 32, which can also make up part of the proposed system, is connected at its bottom end to a submerged riser 34. The riser support 32 is connected at its upper end to the tensioning element 30.

In some embodiments, the riser support 32 is a support of the I-tube type or of the multifunctional bell mouth (MFBM) type, usually employed for supporting risers in SPUs.

Optionally, the tensioning element 30 passes via a deflection pulley 36. This allows for directing the loading of the riser support 32 and, consequently, of the submerged riser 34.

Figure 3:
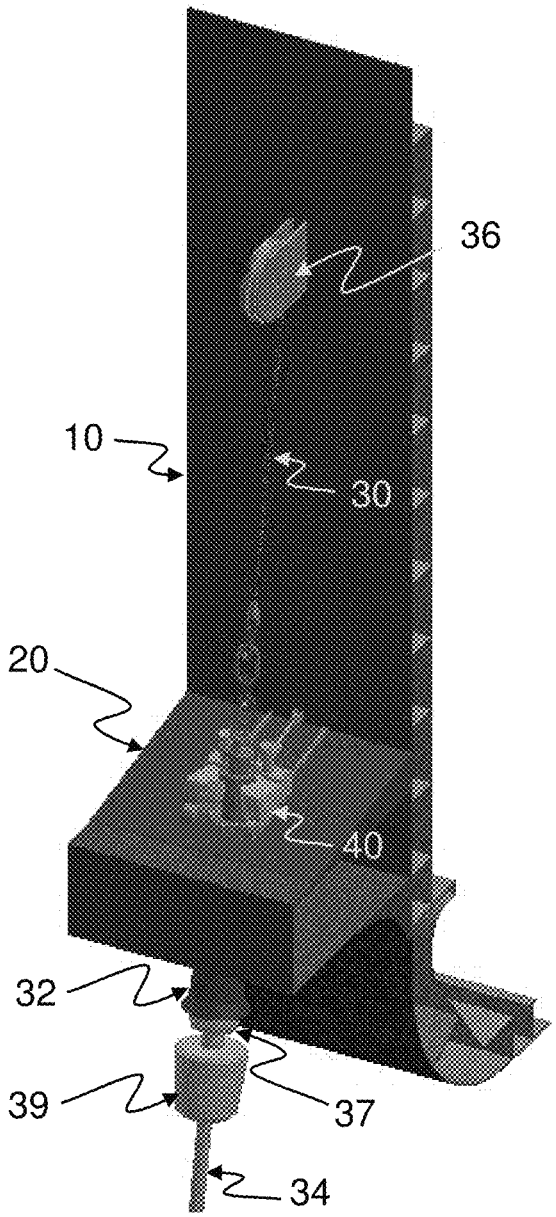
FIG. 3 shows a detailed isometric view of a preferred embodiment of the system of the present disclosure in a locked position.
Figure 4:
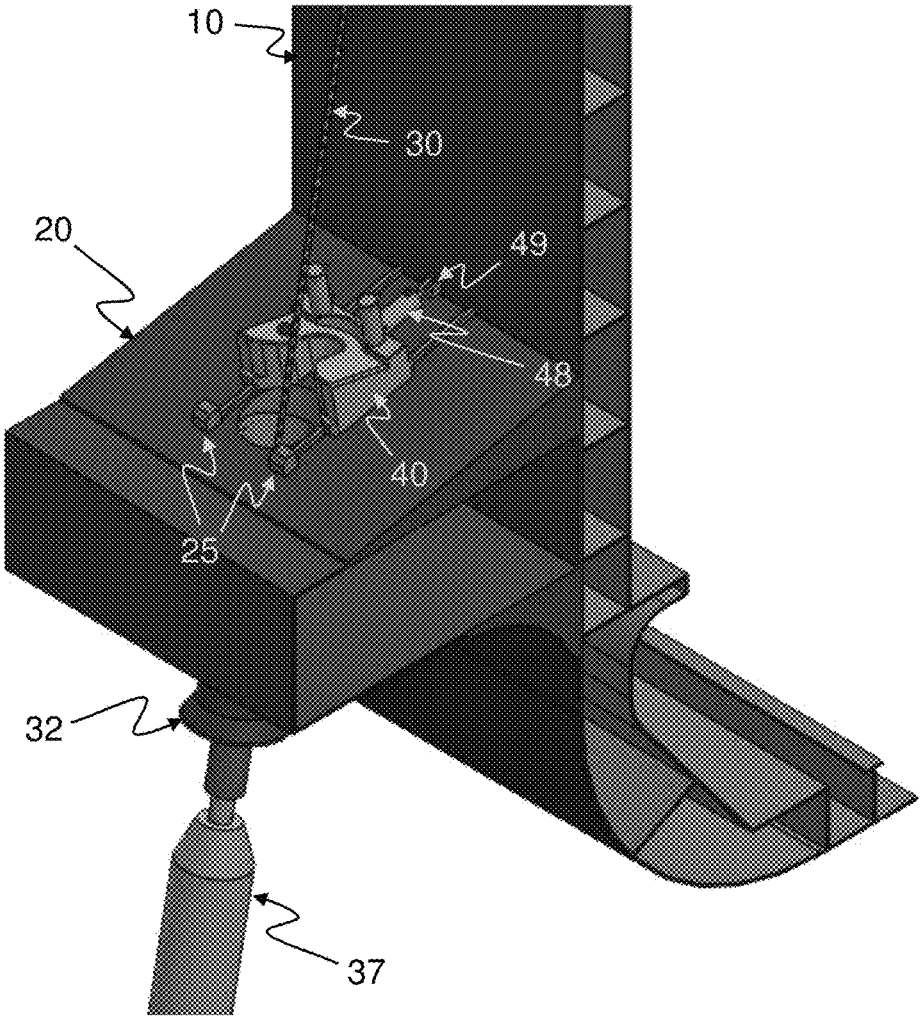
FIG. 4 shows an isometric view of the preferred embodiment of the system of the present disclosure in an unlocked position where a connector has not yet passed through a through-hole of a supporting ledge.

Once the tensioning element 30 and at least part of the riser support 32 have passed through the through-hole 22 (as shown in FIG. 3), as a result of the tensioning of the tensioning element 30, the riser support 32 can be secured relative to the supporting ledge 20 by means of a securing device 40 positioned thereon.

The securing device 40 slides between an unlocked position (FIGS. 4 to 6), away from the through-hole 22, and a locked position (FIG. 8) on the through-hole 22.

In some embodiments, the securing device 40 slides on at least one rail 24. The rail 24 can be located on the supporting ledge 20. In some embodiments, two rails are provided on the supporting ledge 20 for sliding of the securing device 40, as illustrated in the detail in FIG. 2. Optionally, stops 25 are positioned at one or both ends of any rail, to limit the movement of the securing device 40.

In the locked position, the securing device 40 can engage with locking in a connector 38 of the riser support 32 after the connector 38 has passed through the through-hole 22 of the supporting ledge 20, so as to prevent the connector 38 from passing back through the through-hole. That is, once the connector has passed through the through-hole 22 to be on the same side of the through-hole 22 as the securing device 40, the securing device 40 can prevent the connector 38 from returning. In some embodiments, the connector 38 comprises an annular projection for coupling into the securing device 40.

In some embodiments, the securing device 40 comprises a horseshoe shape, where there is a front opening 42 for positioning said securing device 40 around the connector 38 of the riser support 32 and coupling to the annular projection thereof. That is, the front opening 42 can fit under the annular projection on the riser support 32, and the tension in the riser support 32 then biases the annular projection towards the securing device 40, thus securing riser support 32 against the securing device 40. This is discussed in further detail below.

Figure 2:
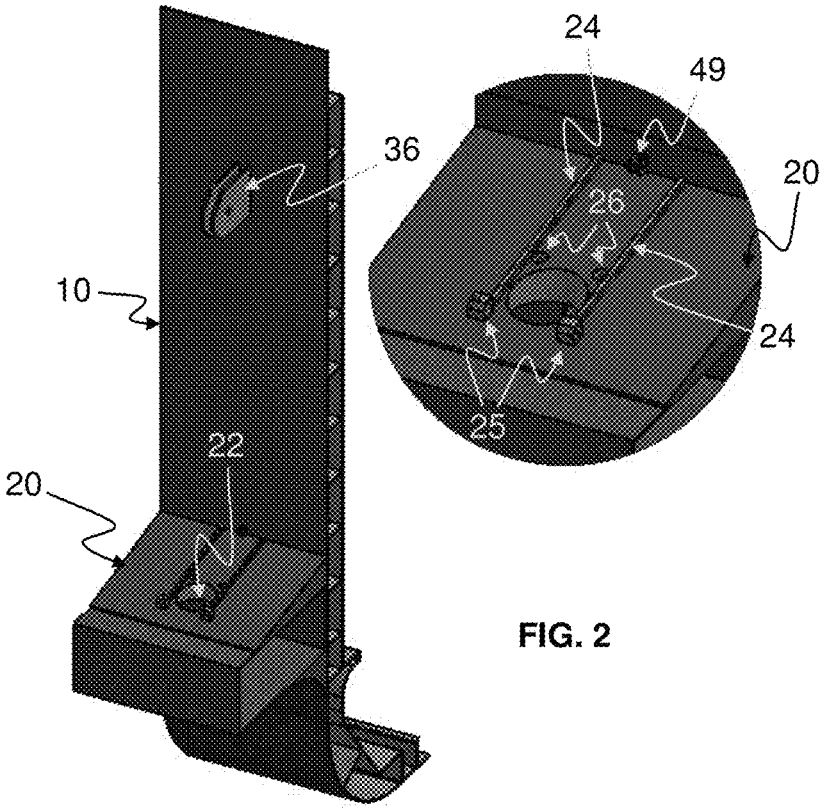
FIG. 2 shows an isometric view of a portion of a body of a SPU where the system of the present disclosure can be installed.

Preferably, the securing device 40 is lockable in the locked position by means of at least one locking pin 44. In some embodiments, locking pin 44 can engage in at least one securing hole 26 of the supporting ledge 20 (as shown in FIG. 2). In some embodiments, two locking pins are provided for coupling in two securing holes of the supporting ledge 20.

In some embodiments, the at least one locking pin 44 is actuated by at least one hydraulic locking cylinder 46. Thus, when the securing device 40 is in the locked position, the at least one hydraulic locking cylinder 46 actuates the at least one locking pin 44 for coupling into the at least one securing hole 26 of the supporting ledge 20 and for securing the riser support 32. That is, the hydraulic locking cylinder can hydraulically propel the pin 44 into the securing hole 26. To disconnect the system, the at least one hydraulic locking cylinder 46 can be actuated so as to uncouple the at least one locking pin 44 from the at least one securing hole 26 of the supporting ledge 20. In this way, the securing device 40 becomes free to move between the locked and unlocked positions. Sliding the securing device 40 to the unlocked position removes the securing device 40 from underneath the annular projection of the connector 38 of riser support 32, thus releasing the riser support 32 from the securing device 40.

Sliding of the securing device 40 between the locked and unlocked positions is effected by means of an actuator 48. In some embodiments, the actuator 48 is at least one hydraulic displacement cylinder. The hydraulic displacement cylinder can be fixed at one end to the securing device 40. The other end of the hydraulic displacement cylinder can be fixed to a fixing element 49 of the supporting ledge 20.

Figure 10:
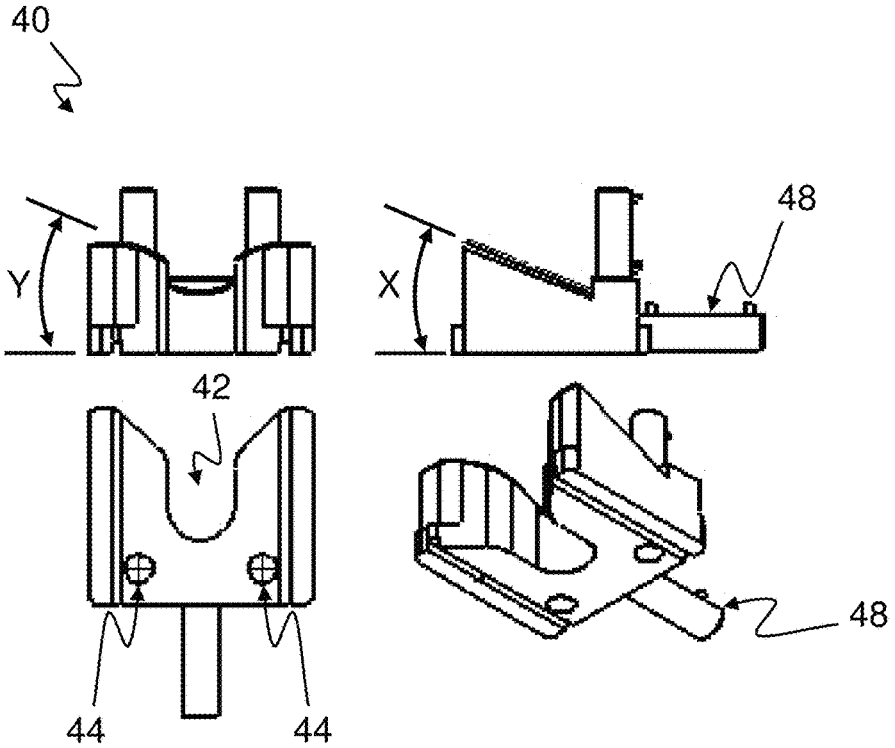
FIG. 10 shows four views of the securing device of FIG. 9, namely a front view, a side view, a bottom view and an isometric bottom view.

In some embodiments, the securing device 40 can further comprise an upper surface, which will come into contact with the connector 38 of the riser support 32. The upper surface can be inclined in at least one direction relative to a bottom surface of the securing device 40, as illustrated in the front and side views in FIG. 10. As can be seen, angles X and Y are formed in two mutually perpendicular directions. This promotes better coupling of the upper surface of the securing device 40 with the connector 38 of the riser support 32. In other words, the sloped upper surface discourages the connector 38 from sliding out of the securing device 40 whilst the securing device 40 is in the locked position. The angles X and Y will vary according to the catenary angle and/or the azimuth angle of the riser 34. In some embodiments, the angles X and Y can correspond to the catenary angle and/or the azimuth angle of the riser 34. The angles X and Y can also vary according to the angle of the supporting ledge 20.

Figure 5:
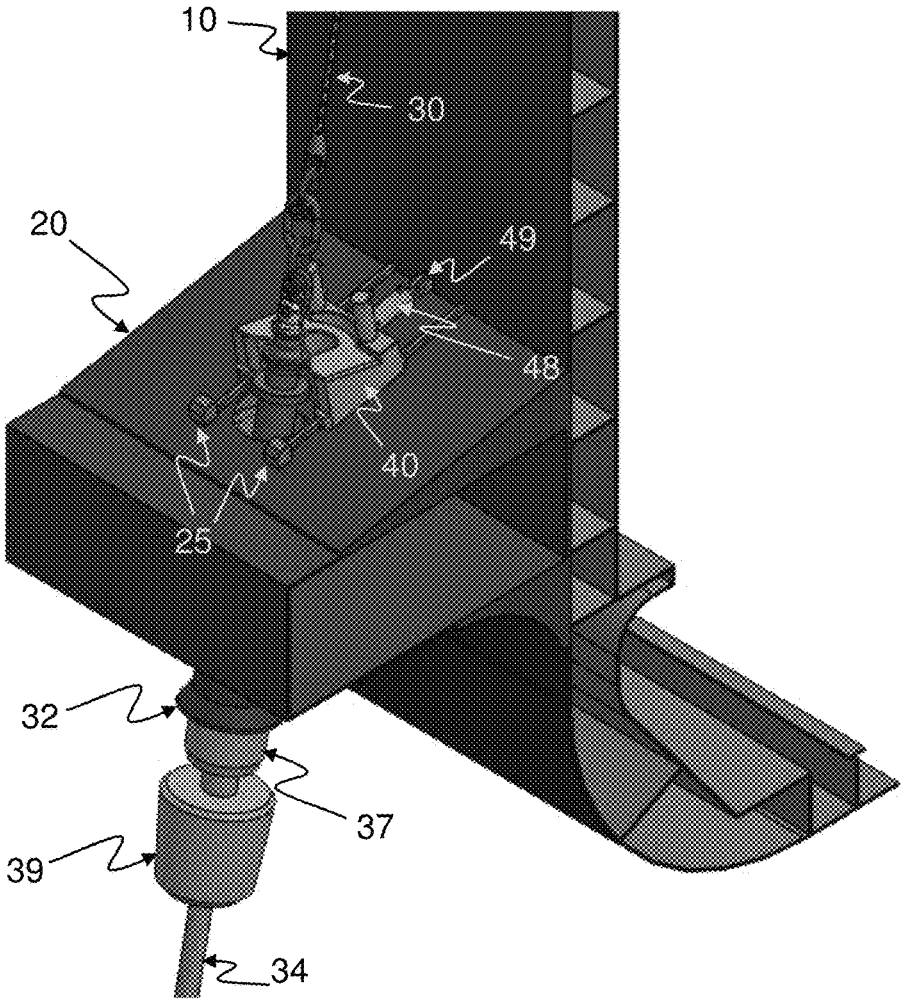
FIG. 5 shows an isometric view of the preferred embodiment of the system of the present disclosure in an unlocked position where the connector is passing through a through-hole of the supporting ledge.
Figure 6:
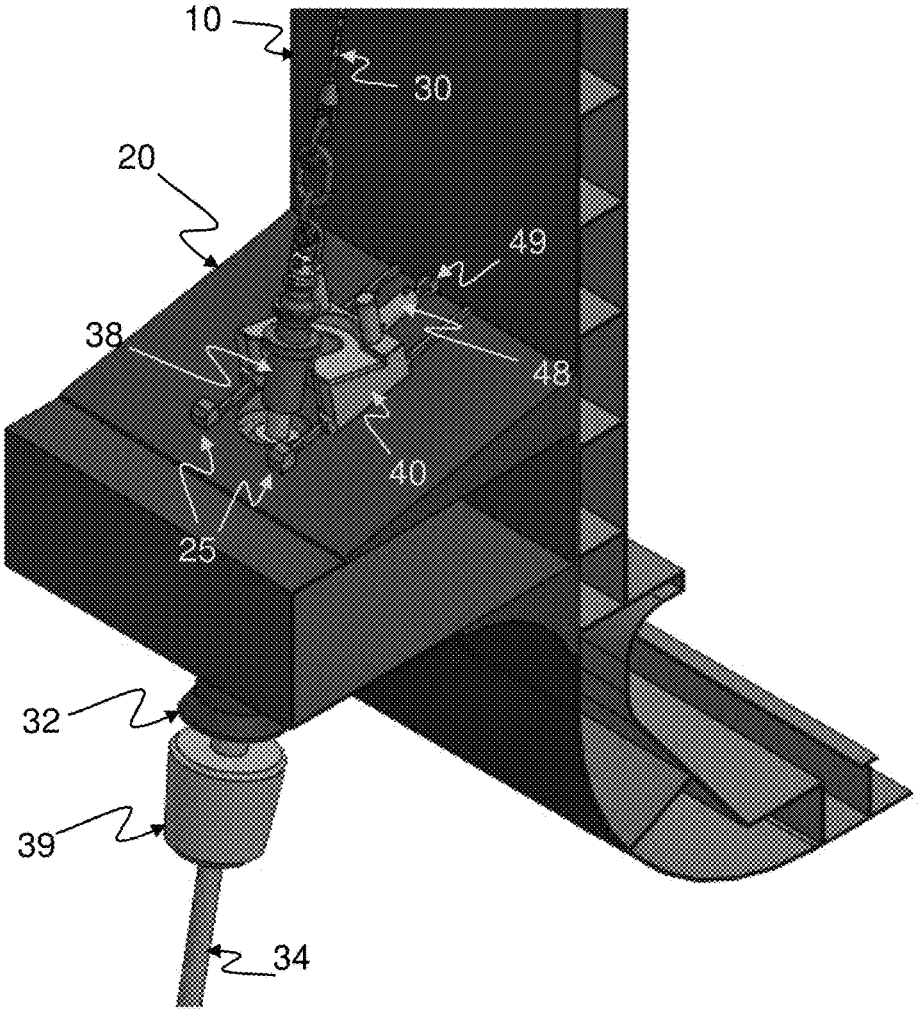
FIG. 6 shows an isometric view of the preferred embodiment of the system of the present disclosure in an unlocked position where the connector has already passed through a through-hole of the supporting ledge.
Figure 7:
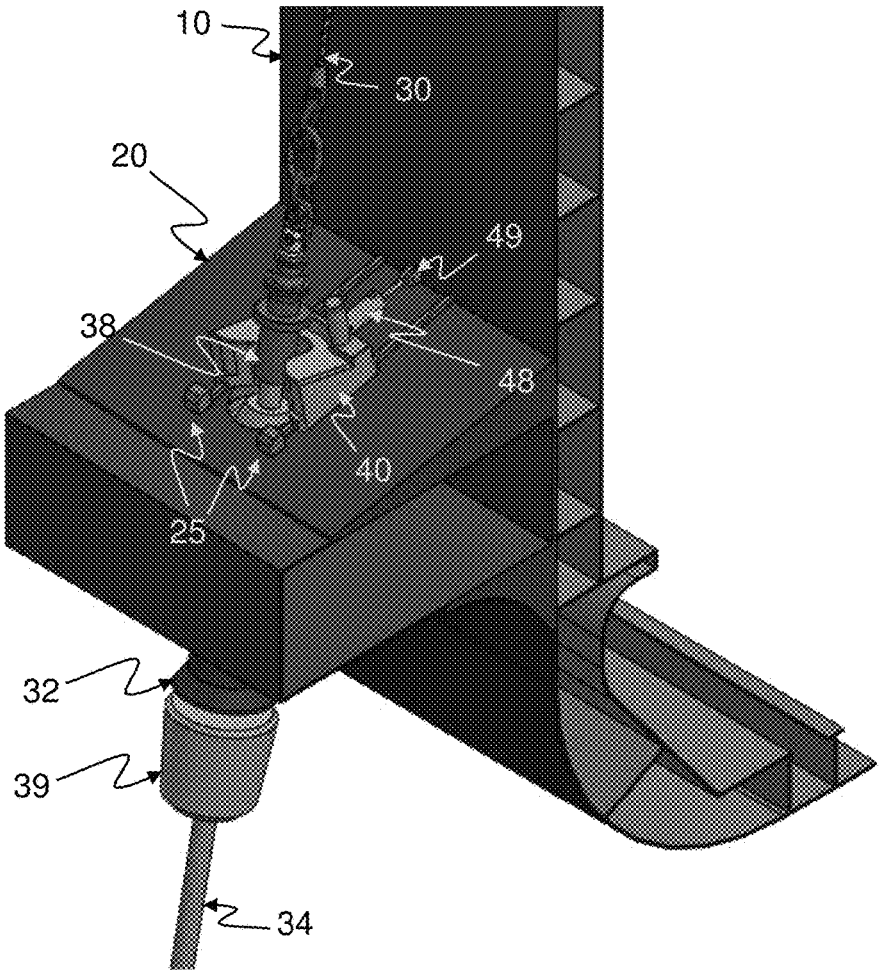
FIG. 7 shows an isometric view of the preferred embodiment of the system of the present disclosure in an intermediate position where a securing device is being moved for securing the connector.
Figure 8:
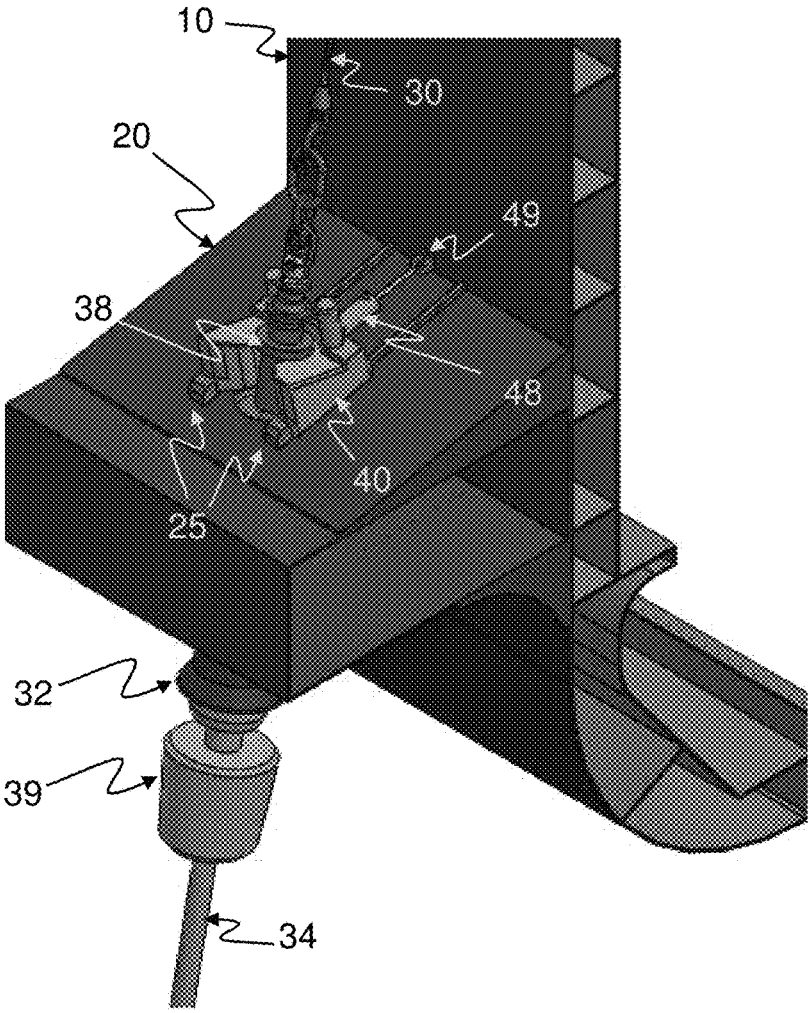
FIG. 8 shows a detailed isometric view of the preferred embodiment of the system of the present disclosure in the locked position.
Figure 9:
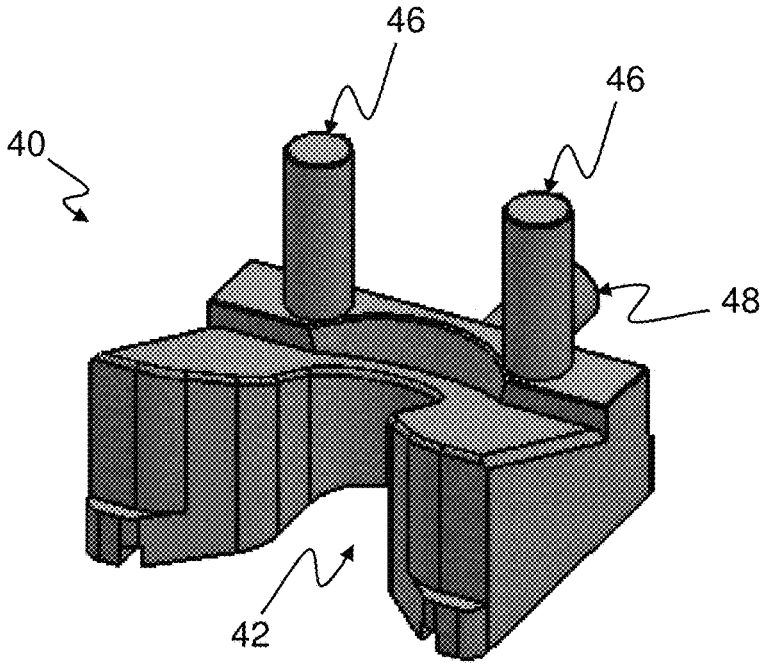
FIG. 9 shows a detailed isometric view of the securing device according to a preferred disclosure of the present invention.

In some embodiments, a centralizing cap 37 (e.g. see FIG. 4) is provided below the riser support 32. Also, in some embodiments, a flexible joint (also known as a flex joint) 39 is provided at the upper end of the riser 34 (i.e. below the riser support 32, as shown in FIG. 6, or below the centralizing cap 37, if present, as shown in FIG. 5).

Optionally, each of the components of the system of the present invention may be treated with at least one of a sliding coating, in the case of moving parts, and an anti-fouling coating.

The present disclosure also provides a method associated with the system proposed above, comprising the steps of: (a) passing, through the through-hole 22 of the supporting ledge 20, at least part of the riser support 32 connected at its bottom end to the submerged riser 34 and at its upper end to the tensioning element 30; and (b) sliding, relative to the supporting ledge 20, the securing device 40 located on the supporting ledge 20, the securing device 40 being driven by the actuator 48.

In the proposed method, the securing device 40 can slide between an unlocked position and a locked position on the through-hole 22. In the locked position, the securing device 40 can engage with locking in the connector 38 of the riser support 32 after the connector 38 has passed through the through-hole 22 of the supporting ledge 20.

The steps of the method can be performed without direct user manipulation, and can instead be performed remotely. That is the action of passing the riser support 32 through the through-hole 22 can be controlled by applying tension to the tensioning element 30 through a remotely controlled tensioning or winding system, for example. The action of sliding can be controlled by remotely operating actuator 48.

In some embodiments, the method can comprise an additional step of locking the securing device 40 in the locked position by means of at least one locking pin 44. The locking pin 44 can be a pin that engages in at least one securing hole 26 of the supporting ledge 20.

In some embodiments, the method can comprise an additional step of unlocking the securing device 40 from the locked position. This can be achieved by releasing at least one locking pin 44 from the at least one securing hole 26 of the supporting ledge 20.

Thus, the present disclosure provides a system and an autonomous method for securing a riser support that does not require diving operations for manual connection and disconnection of the system or the need for the assistance of a ROV.

Numerous variations falling within the scope of protection of the present application are permitted. Thus, it is emphasized that the present invention is not limited to the particular configurations/embodiments described above. Modification of the above-described apparatuses and methods, combinations between different variations as practicable, and variations of aspects of the invention that are obvious to those of skill in the art are intended to be within the spirit and scope of the claims.

What is claimed is:

1. A system for securing or releasing a riser support, wherein the autonomous system comprises:

a riser support connectable at its bottom end to a submerged riser and at its upper end to a tensioning element, the riser support having a connector;

a supporting ledge comprising a through-hole, through which the tensioning element and at least part of the riser support may pass;

a securing device located on the supporting ledge, said securing device being slidable along the supporting ledge from an upper position to a lower position and driven by an actuator;

wherein the securing device is configured to slide, with respect to the through-hole, between an unlocked position and a locked position, wherein, in the locked position, the securing device can engage the connector of the riser support after the connector has passed through the through-hole of the supporting ledge, so as to prevent the connector from passing back through the through-hole.

2. The system for securing or releasing a riser support according to claim 1, wherein the securing device slides on at least one rail located on the supporting ledge.

3. The system for securing or releasing a riser support according to claim 1, wherein the securing device is lockable in the locked position by means of at least one locking pin that can engage in at least one securing hole of the supporting ledge.

4. The system for securing or releasing a riser support according to claim 3, further comprising at least one hydraulic locking cylinder for driving the at least one locking pin.

5. The system for securing or releasing a riser support according to claim 1, wherein the actuator is at least one hydraulic displacement cylinder.

6. The system for securing or releasing a riser support according to claim 1, wherein the securing device comprises a horseshoe shape in which there is an opening for positioning said securing device around the connector of the riser support in the locked position.

7. The system for securing or releasing a riser support according to claim 1, wherein the securing device comprises an upper surface and a lower surface, wherein the upper surface comes into contact with the connector of the riser support, and is inclined in at least one direction relative to the bottom surface.

8. The system for securing or releasing a riser support according to claim 7, wherein the inclination of the upper surface of the securing device relative to at least one direction corresponds to at least one of the catenary angle and the azimuth angle of the riser.

9. The system for securing or releasing a riser support according to claim 1, wherein the riser support is a support of the I-tube type or MFBM.

10. The system for securing or releasing a riser support according to claim 1, further comprising a deflection pulley, wherein the tensioning element passes via the deflection pulley.

11. A method for securing a riser support, wherein the method comprises the steps of:

passing, through a through-hole of a supporting ledge, at least part of a riser support connected at its bottom end to a submerged riser and at its upper end to a tensioning element; and sliding, along the supporting ledge, a securing device located on the supporting ledge, from an upper position to a lower position, said securing device being driven by an actuator;

wherein the securing device slides between an unlocked position and a locked position relative to the through-hole, and wherein, in the locked position, the securing device can engage with a connector of the riser support after the connector has passed through the through-hole of the supporting ledge, so as to prevent the connector from returning through the through-hole.

12. The method for securing a riser support according to claim 11, wherein the method comprises an additional step of locking the securing device in the locked position by means of at least one locking pin that can engage in at least one securing hole of the supporting ledge.

13. The method for securing a riser support according to claim 12, wherein the method comprises an additional step of unlocking the securing device from the locked position by releasing at least one locking pin of the at least one securing hole of the supporting ledge.

14. A method for releasing a riser support, wherein the method comprises the steps of:

providing a securing device in a locked position on a supporting ledge, engaged with a riser support, so as to prevent the riser support passing through a through-hole of the supporting ledge, wherein the riser support is connected at its bottom end to a submerged riser and at its upper end to a tensioning element;

sliding, along the supporting ledge, the securing device, from an upper position to a lower position, said securing device being driven by an actuator, wherein the securing device slides between the locked position and an unlocked position relative to the through-hole in the supporting ledge, so as to disengage from the riser support; and passing, through the through-hole of the supporting ledge, at least part of the riser support.

* * * * *